United States Patent [19]

Frigeni

[11] 4,164,195

[45] Aug. 14, 1979

[54] IMMERSION APPARATUS CARRYING DETACHABLE AND SELF-CONTAINED PROSPECTING AND SUBMARINE WORK UNITS

[76] Inventor: Gianfranco Frigeni, Via Portadipinta, 38 - Bergamo, Italy

[21] Appl. No.: 918,435

[22] Filed: Jun. 23, 1978

[30] Foreign Application Priority Data

Jul. 29, 1977 [IT] Italy ..... 2923 A/77

[51] Int. Cl.[2] ..... B63G 8/24

[52] U.S. Cl. ..... 114/322

[58] Field of Search ..... 114/312–315, 114/322–326, 330–331, 334–337, 66; 405/185

[56] References Cited

U.S. PATENT DOCUMENTS

| | | | |
|---|---|---|---|
| 3,369,368 | 2/1968 | Wilson | 114/333 |
| 3,766,742 | 10/1973 | Smith et al. | 114/337 |
| 3,929,533 | 12/1975 | Horn | 114/312 |

*Primary Examiner*—Jesus D. Sotelo

[57] ABSTRACT

Immersion apparatus for carrying out submarine works, comprising a master chamber connected to a surface unit and intended to be lowered to the area of submarine work, self-propelled work units branching out from said master chamber and having atmospheric pressure therein and being connected thereto by a so-called umbilical cord, the work units being provided with work arms operable from inside thereof by pushbuttons and pedals.

5 Claims, 5 Drawing Figures

2
1
5'
6
8
3
7
8
7
7

5

4
3
8
7
6
6
6
8
7

IMMERSION APPARATUS CARRYING DETACHABLE AND SELF-CONTAINED PROSPECTING AND SUBMARINE WORK UNITS

This invention relates to an immersion apparatus carrying detachable and self-contained prospecting and submarine work units, at the submarine work area provided with a master chamber, from which the work units branch out, while remaining connected thereto by means of an umbilical cord.

At present, when carrying out submarine works, use is made either of small propeller submarines or frogmen and divers in a diving suit. Obviously, the small submarines used are costly and complex apparatuses, inter alia requiring a continuous servicing and setting up, the power thereof is that of the operating means and accordingly cannot be adapted to the various instantaneous requirements and additionally the submarine propeller may be a damage cause or source for surrounding cables and pipelines, in addition to being dangerous for any nearby frogmen or divers. Use of frogmen involves substantial disadvantages, whereby a frogman is requested to be of excellent physical conditions, long stay times in decompression chamber under medical assistance are required, the frogman's operation time or duration is limited, a poor efficiency on the bottom is obtained due to pressure and work conditions to which a frogman is subjected, in addition to various logistical problems and cost of installations and breathing mixtures and so on.

It is the object of the present invention to provide an immersion apparatus of simple design, economical and high reliability, particularly allowing the use of workmen not necessarily specialized with frogman specialization, but allowing instead the use of highly and specifically qualified personnel for the work to be carried out, in that the movable unit operator will work at a pressure of one atmosphere.

According to the invention, this is accomplished by an immersion apparatus for the above specified objects, associated with a surface unit with sea lowering systems on said surface unit and connected by cables to the immersion apparatus, characterized by comprising a master chamber driven by means of tensioned constant force cables to the proximity of the operating site or location, on said master chamber a coupling and transfer assembly at the bottom thereof with at least one coupling chamber designed to form a watertight chamber, each of which provided with a pump for sea water inlet and outlet, with removable sealing means, at least two movable units for prospection and work on the sea bottom, each of the movable units being communicable with the master chamber through the watertight chamber of said coupling and transfer assembly and also forming the bottom of the watertight chamber for transfer, wherein each of said movable units include a cylinder-like body which is internally hollow and closed at the lower end and having a removable closure at the upper end, provided with work and inspection portholes with work iron hands as arms projecting from outside and controllable from inside said movable unit, and propelling means also controllable from inside said movable unit by pedal system, each movable unit being connected by a so-called umbilical cord with the master chamber and comprising a releasable ballast and means for fast disconnection of the iron hand arms and umbilical cord for a possible fast emergency ascent.

According to an embodiment of the invention, said master chamber comprises an immersion or diving bell.

According to another preferred embodiment of the invention, said master chamber comprises a "habitat" lowered on the sea bottom and connected with the floating vessel by means of an immersion or diving bell.

It is within the scope of the invention that the propelling means for the movable units comprise independent jets facing in horizontal and vertical directions.

These and further objects, features, details and advantages of the apparatus according to the present invention will become more apparent to those skilled in the art from the following short detailed description of an unlimited exemplary embodiment in connection with the accompanying drawings, in which.

Figures 1, 2:
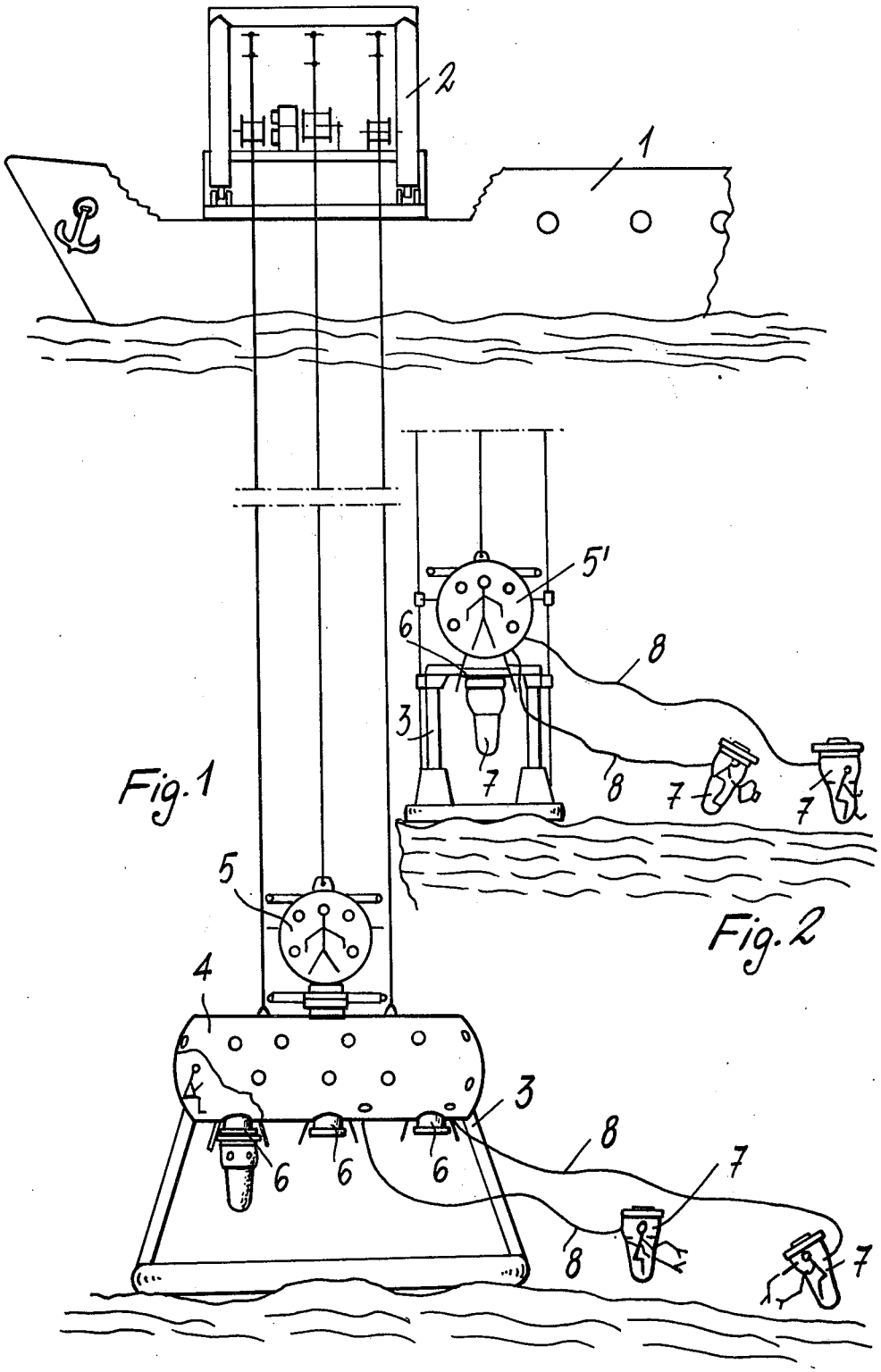
FIG. 1 is a fully schematic view showing an apparatus according to the invention as associated with a surface or floating unit.
FIG. 2 shows a modified embodiment relative to the master chamber shown in FIG. 1.

Referring now to the drawings, and particularly to FIGS. 1 and 2, reference numeral 1 denotes a surface or floating unit carrying sea lowering systems 2. At the sea bottom or work area, support and rest means 3 are provided for supporting the various equipments. An apparatus according to the invention comprises a master chamber which may be formed either by a habitat 4, as shown in FIG. 1 and which is connected by an immersion or diving bell 5 with the floating vessel, or as shown in FIG. 2, said master chamber may be formed by immersion or diving bell 5'. The master unit or chamber is guided or driven by tensioned constant force cables to the proximity of the operating site or location. This master chamber 4 or 5' comprises special clamping transfer couplings, as shown at 6 in FIGS. 1 and 2. These couplings 6 enable the transfer of an operator from said master chamber 4 or 5' to self-contained movable work and prospection units 7, which may be then disconnected from the master chamber, while remaining coupled thereto by means of a respective umbilical cord 8.

Figure 3:
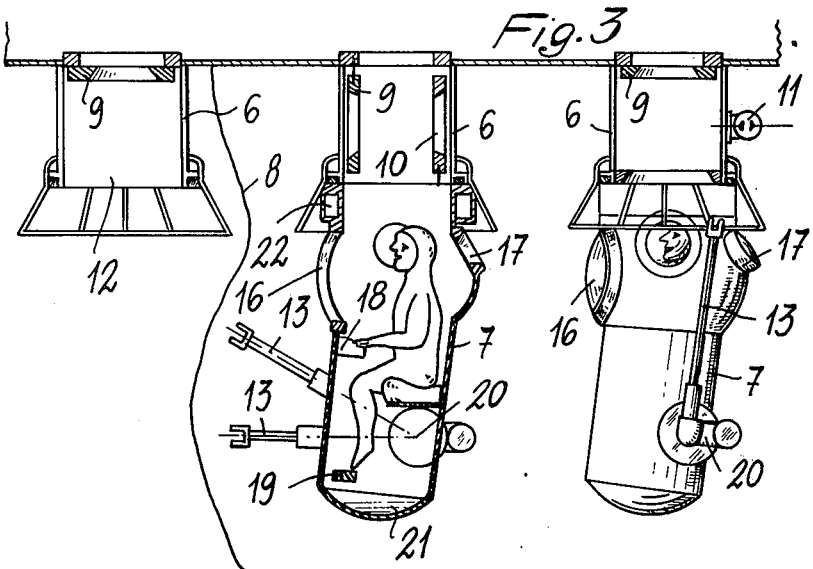
FIG. 3 is a view showing the movable units according to the invention being transferred relative to the clamping and transferring assembly of the master chamber.
Figure 4:
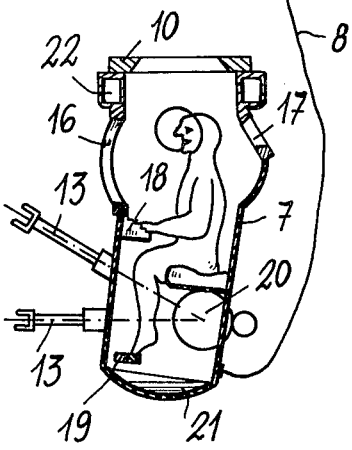
FIGS. 4 and 5 are schematic sectional and perspective views, respectively, showing a movable unit according to the invention.
Figure 5:
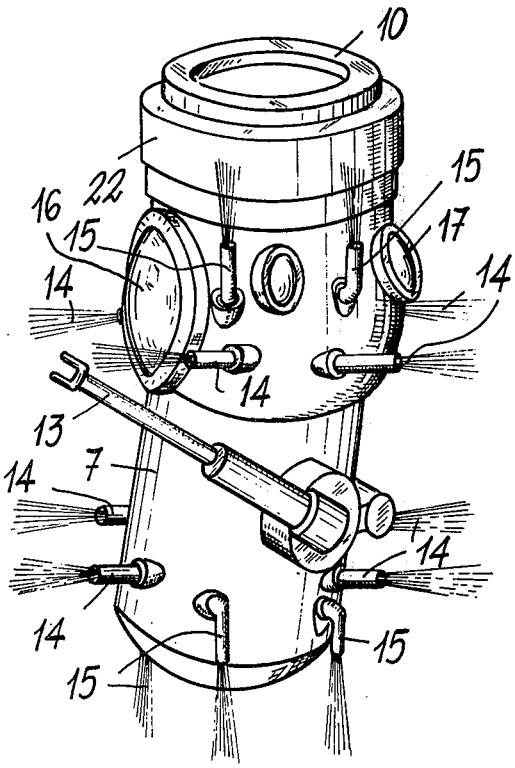

Referring now to FIGS. 3 through 5, a more detailed short description will be given for said movable units 7 and coupling transfer system 6 between said movable units 7 and master chamber, the latter being formed by either a habitat 4 or bell 5'. As it will be appreciated, each of said couplings 6 comprise a tubular body at the bottom terminating with an open bell shape. At the top, such a tubular body is closed relative to chamber 4 by an eventually openable porthole 9, whereas bottom closing is provided, if required, by top porthole 10 of movable unit 7. Therefore, an operator in said master chamber 4 may move down from the chamber to reach the inside of device or unit 7, as shown at the mid-portion of FIG. 3, where both the portholes are open and unit 7 is retained in place by the pressure of the surrounding water. Thus, after closing said portholes 9 and 10, should water be introduced through sea pump 11 into chamber 12, when the inner pressure is equal to the outer pressure, unit 7 can be separated with the aid of iron hand arms 13, then moving to the work site or location by a jet propelling system, more clearly shown in FIG. 5.

Each unit 7 remains connected to the master chamber by a so-called umbilical cord, while another operator stays in the master chamber as an assistant. Iron hand arms 13 are operated by an electric motor, or may be of oleodynamic type. As above mentioned, unit 7 comprises a plurality of horizontal propelling jets, shown at 14 in FIG. 5, and a plurality of vertical propelling jets, shown at 15 in FIG. 5. Of course, the matter shown in FIG. 5 is by mere way of indication and relates to a principle illustration. Obviously, units 7 are provided with work and inspection portholes 16 and 17, respectively. Within each unit a comfortable operator seat is provided with a control keyboard 18 for iron hand arms 13 and control rudder bar 19 for jets 14 and 15, for which a pump and tank assembly is provided as shown as a whole at 20. The rudder bar control for the independent jets 14 and 15 enables the operator to work with his free hands. Reference numeral 21 designates a detachable bottom ballast and reference numeral 22 designates a top ballast. In case of emergency for fast ascent, said bottom ballast can be detached and top ballast may be filled with $CO_2$ or air. Similarly, iron hands 13 and umbilical cord 8 are also rapidly detachable. Unit 7 will be further provided with all of the required safety devices for emergency cases, such as stand-by battery, electrical torch and the like.

Therefore, each of units 7 accordingly make up an independent and reliable submarine work assembly, wherein operations are carried out at atmospheric pressure and thus not requiring personnel of frogman qualification . Additionally, these units 7 may continuously operate, as it would be merely sufficient to bring for a moment each unit to master chamber 4 or 5', replace the operator who will move up to surface, while a fresh operator will move in unit 7. The reverse process described in connection with separation will be followed for re-enter. Unit 7 is caused to insert by its top in chamber bell 6, also with the aid of arms 13. Chamber 12 is then pumped down by means of pump 11 and finally, the operator is transferred by opening portholes 9 and 10.

What I claim is:

1. An immersion apparatus for carrying out submarine works, associated with a surface unit with sea lowering systems on said surface unit and connected through cables to the immersion apparatus, comprising a master chamber guided and driven by means of tensioned constant force cables to the proximity of operation site or location, on said master chamber a coupling and transfer assembly at the bottom thereof with at least one coupling chamber designed to form a watertight chamber, each of which is provided with a pump for sea water inlet and outlet, with removable closure means, at least two movable units for prospection and work on the sea bottom, each of the movable units being capable of communication with the master chamber through the watertight chamber of said coupling and transfer assembly and forming the bottom of the watertight chamber for said transfer, assembly wherein each of said movable units comprise an internally hollow cylinder-like body closed at the lower end and having a removable closure at the upper end, provided with work and inspection portholes with work iron hands in the form of arms projecting from outside and controllable from inside said movable unit, as well as propelling means also controllable from inside said movable unit by a pedal system, each of said movable units being connected by an umbilical cord with the master chamber and comprising a detachable ballast, the iron hand arms and the umbilical cord being rapidly detachable in case of fast emergency ascent.

2. An apparatus according to claim 1, wherein said master chamber comprises an immersion or diving bell.

3. An apparatus according to claim 1, wherein said master chamber comprises a "habitat" lowered on the sea bottom and connected with a floating vessel by means of an immersion or diving bell.

4. An apparatus according to claim 1, wherein the propelling means for the movable units comprise independent jets facing in horizontal and vertical directions, respectively, using the compression and discharge of sea water.

5. An apparatus according to any one of claims 1–4, wherein said movable units operate with the interior thereof at atmospheric pressure.

* * * * *